United States Patent [19]

Fink, Jr.

[11] Patent Number: 4,559,982

[45] Date of Patent: Dec. 24, 1985

[54] PRESSURE ACTUATED POPPET VALVE FOR FUEL DISPENSING NOZZLE

[75] Inventor: Arthur C. Fink, Jr., Lonedell, Mo.

[73] Assignee: Husky Corporation, Pacific, Mo.

[21] Appl. No.: 565,592

[22] Filed: Dec. 27, 1983

[51] Int. Cl.[4] ..... B65B 1/30

[52] U.S. Cl. ..... 141/206; 141/218; 141/225; 141/392

[58] Field of Search ..... 141/192, 198, 206–229, 141/392

[56] References Cited

U.S. PATENT DOCUMENTS

| | | | |
|---|---|---|---|
| 2,363,123 | 11/1944 | Franck | 141/209 |
| 2,787,294 | 4/1957 | Carriol | 141/209 |
| 3,088,500 | 5/1963 | Payne | 141/208 |
| 3,811,486 | 5/1974 | Wood | 141/208 |

*Primary Examiner*—Stephen Marcus
*Assistant Examiner*—Ernest G. Cusick
*Attorney, Agent, or Firm*—Paul M. Denk

[57] ABSTRACT

A pressure actuated poppet valve for a fuel dispensing nozzle is disclosed having a piston therein movable between a first and a second position. In the first position, the piston holds a plurality of coupling or latching balls in coupling engagement with an axially movable stem so that upon a user pulling the actuator handle or lever of the dispensing nozzle, the poppet valve is opened for the dispensing of fuel. When the dispenser goes off such that there is no fuel pressure in the hose upstream from the nozzle, a spring within the poppet valve pushes the piston from its first to its second position, thus permitting the coupling balls to move clear of the stem, allowing the poppet valve to close, and preventing opening of the poppet valve upon the subsequent actuating of the nozzle handle. The poppet valve has a flow restriction port which permits fuel to flow in and out of the poppet valve such that a predetermined time delay will result between the time the fuel dispenser is de-energized and the time the dispensing nozzle becomes inoperable. Upon energization of the dispenser, the fuel pressure will cause the piston to move to its first position, thus again enabling actuation of the fuel dispensing nozzle.

10 Claims, 7 Drawing Figures

PRESSURE ACTUATED POPPET VALVE FOR FUEL DISPENSING NOZZLE

BACKGROUND OF THE INVENTION

This invention relates to a fuel dispensing nozzle, such as may be utilized to dispense a variety of liquid fuels (e.g., gasoline, diesel fuel, and the like), and particularly to such a fuel dispensing nozzle which automatically shuts off the flow of liquid fuel upon the fuel tank of a vehicle becoming filled. Even more particularly, this invention relates to such a fuel dispensing nozzle which is utilized with a prepay, self-service filling station.

In recent years, there has been a marked trend toward the self-service dispensing of gasoline and other fuel products by the consumer into his vehicle. Several years ago, when self-service service stations came into existence, the service station operator merely permitted the retail customer to dispense the fuel into his vehicle without the aid of a service attendant. The customer would then walk inside the service station, report the amount of fuel purchased, and pay for the fuel. However, in many instances, service station operators found that a certain percentage of their customers would merely drive off after having dispensed the fuel, without paying.

In an effort to thwart such thefts of fuel, so-called "prepay" self-service stations were developed in which the customer first had to approach the service station attendant and prepay for the amount of fuel to be dispensed before the attendant would energize the fuel dispenser. Then, the customer would return to his car, insert the dispensing nozzle in his fuel tank, and dispense the already paid for quantity of fuel. When the predetermined, prepaid amount of fuel had been dispensed, the dispenser would automatically shut off, and the user would replace the dispensing nozzle in its appropriate holder.

However, in certain instances, it has been observed that certain conventional automatic fuel dispensing nozzles do not normally automatically shut off when the prepaid amount of fuel is dispensed and when the dispenser is automatically de-energized thus terminating the flow of fuel. If the customer does not shut off the nozzle but instead hangs it back on the dispenser in the open position, the next customer who prepays for his purchase may find that the dispensing nozzle is still in the open position such that when the dispenser is energized, fuel will be immediately dispensed therefrom, even though the dispenser nozzle is not yet inserted into the customer's tank.

Reference may be made to such U.S. Pat. Nos. as 4,397,447, 4,203,478, 4,199,012, 4,196,759, 4,139,032, 3,877,480, 3,653,415, 3,273,609, 3,196,908, and 3,805,600 for disclosures of automatic shut-off dispensing nozzles having a variety of poppet valve configurations generally in the broad field of this invention.

SUMMARY OF THE INVENTION

Among the several objects and features of the presented invention may be noted the provision of a dispensing nozzle having a pressure actuated poppet valve of the present invention which automatically closes the dispensing nozzle shortly after the dispenser or pump is de-energized so as to prevent the dispensing of fuel upon the re-energization of the dispenser;

The provision of such a pressure poppet which may be retrofitted into certain existing dispensing nozzles;

The provision of such a fuel dispensing nozzle and pressure actuated poppet valve which delays the closing of the dispensing nozzle for a predetermined length of time (e.g., 10–15 seconds) after the dispenser is de-energized so as to prevent nuisance-type shut-offs, and so as to allow sufficient time for the nozzle to drain after it is tested during manufacture of the dispensing nozzle; and The provision of such a fuel dispensing nozzle and pressure operated poppet valve therefor which enhances the safety of prepay, self-service service stations, which is reliable in operation, which is easy to use by the customer without special instructions, and which has a long service life.

Briefly stated, a fuel dispensing nozzle has a fuel flow path therethrough having an inlet and an outlet. A valve seat is provided within the nozzle constituting a part of the flow path. A normally closed poppet valve is cooperable with the valve seat for blocking the flow of fuel through the flow path. A spring biases the poppet valve toward its normally closed position. Means, including a stem cooperable with the poppet valve, extends exteriorally of the nozzle for selectively moving the poppet valve from its normally closed position against the bias of the spring to permit the dispensing of fuel. More specifically, this invention concerns a poppet valve having a poppet valve housing with a cylindric bore therein. The poppet valve housing is engageable by the spring and is sealingly engageable with the valve seat when the poppet valve is in its normally closed position so as to block the flow of fuel through the nozzle. A piston is sealably, slidably disposed within the cylindric bore and is movable between a first and second position. The poppet valve has means engageable with the stem for coupling the poppet valve to the stem for opening of the poppet valve upon axial movement of the stem in one direction. The coupling means is movable between a coupling position in which the coupling means is in engagement with the stem such that axial movement of the stem in the one direction causes movement of the poppet valve from its closed position toward its open position and an uncoupling position. The poppet valve housing has a port for communication between the portion of the flow path upstream from the valve seat and the cylindric bore therewithin whereby fluid pressure upstream from the valve seat acts on the piston and forces it toward its first position which in turn effects movement of the coupling means to its coupling position enabling actuation of the nozzle. A spring is provided for biasing the piston toward its second position so that upon fluid pressure upstream from the valve seat decreasing below the fluid pressure within the cylindric bore, this last-mentioned piston spring biases the piston toward its second position thereby permitting the coupling means to move from its coupling to its uncoupling position and thus disabling the nozzle.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
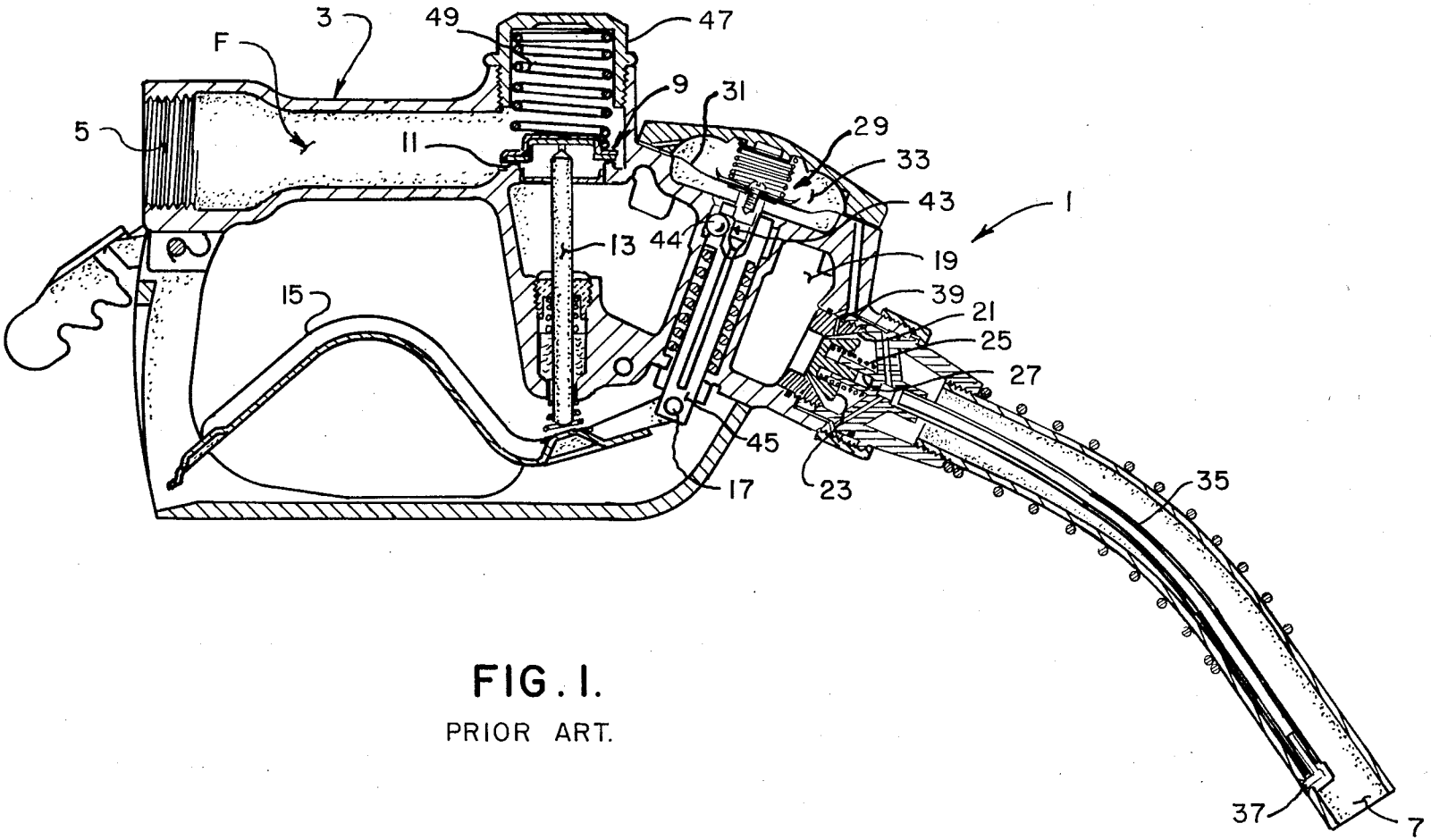
FIG. 1. PRIOR ART.
FIG. 1 is a vertical cross sectional view of a typical prior art automatic shut-off fuel dispensing nozzle having a prior art poppet valve therein shown in its normally closed position.

Referring now to the drawings, an automatic shut-off fuel dispensing nozzle of the present invention is indicated in its entirety by reference character 1. The nozzle is shown to have a housing 3 of cast aluminum, or other suitable material, having a fluid flow passage F therethrough, with the flow passage having an inlet 5 and an outlet 7. It will be appreciated that inlet 5 is provided with internal threads so that the dispensing nozzle may be threaded on a dispensing hose or the like (not shown). A prior art poppet valve assembly, as generally indicated at 9, is disposed within housing 3 and is cooperable with a valve seat 11 within the flow passage for movement between a closed position (as shown in FIG. 1) in which the poppet valve blocks the flow of fuel through the dispensing nozzle and an open or raised position (not shown) in which the poppet valve member is clear of valve seat 11 so as to permit the flow of fuel from inlet 5 to spout 7. Thus, poppet valve 9 constitutes a control valve for the nozzle.

An axially movable stem 13 is provided which extends exteriorally of housing 3. This stem is engagable by a handle 15 pivotally attached to the dispensing nozzle, as indicated at 17, for effecting opening of poppet valve 9 so as to permit the selective dispensing of fuel at various flow rates, depending on the distance poppet valve 9 is displaced from its seat 11.

Housing 3 further includes a so-called main body cavity, as indicated at 19, downstream from valve seat 11 into which the fuel flows upon passing through the valve seat. The fuel exits the main body cavity into a venturi, as generally indicated at 21, before it enters the upper end of outlet spout 7. A normally closed check valve 23 is provided in venturi 21 and the check valve is biased toward its closed position by means of a compression coil spring 25 and the check valve is maintained centered with respect to the venturi by means of a guide 27. The normally closed check valve prevents the leaking of fuel from main body cavity 19 upon closing of poppet valve 9. It will be appreciated that upon opening of poppet valve 9, fuel pressure within main body cavity 19 forces the check valve open against the bias of spring 25 and permits the fuel to be dispensed from the nozzle.

As is conventional, means, as generally indicated at 29, is provided for automatically terminating the flow of fuel from dispensing nozzle 1 in the event the container or fuel tank into which the fuel is being dispensed becomes filled up to the level of the lower end of dispensing spout 7. This automatic shut-off means includes a diaphragm actuator, as indicated at 31, which effects the release of the plunger carrying fulcrum or pivot point 17 for handle 15 which in turn releases stem 13 so that the poppet valve 9 of the present invention will return to its normally closed position under the bias of its spring thus blocking the flow of fuel.

More particularly, a so-called atmospheric pressure chamber 33 is provided in housing 3 on one side of the diaphragm actuator 31, and this atmospheric chamber is in communication with the atmosphere by means of a series of passageways within the housing 3 which in turn are in communication with a vent tube 35 extending substantially lengthwise of spout 7 to a vent port 37 proximate the outer end of spout 7. A plurality of so-called vacuum ports 39 are provided in venturi 31 and are in communication with the passages in communication with vent tube 35 for purposes as will appear. A plurality of detent balls 41 cooperate with a movable tapered pin 43 which in turn is carried by a plunger 45, the lower end of the plunger having handle 15 pivotally attached thereto by fulcrum pin 17. Normally, diaphragm chamber 33 is vented to the atmosphere by vent tube 35. As long as the vent tube and vent 37 are open (i.e., uncovered by fuel on the outside of spout 7), the vacuum in chamber 33 will be broken and diaphragm actuator 31 will maintain detent balls 41 in their position shown in FIG. 1, permitting stem 13 to be moved axially inwardly of housing 3 upon the user moving handle 15 toward the housing. However, if the fuel level in the fuel tank of the vehicle rises so as to cover vent port 37, air will be prevented from entering vent tube 35 and the vacuum within chamber 33 will cause the diaphragm actuator 31 to raise pin 43 which in turn will release detent balls 41. Then, plunger 45 will move outwardly moving pivot pin 17 which in turn releases stem 13 and permits poppet valve 9 to be automatically returned to its closed position blocking the flow of fuel through the dispensing nozzle. Generally, the construction and operation of the automatic shut-off features of this valve are well known by those skilled in the art.

Figure 2:
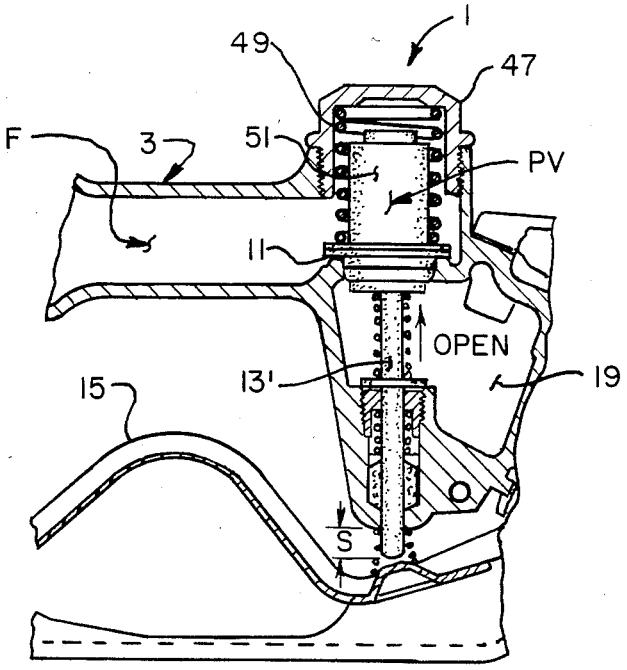
FIG. 2 is a view similar to FIG. 1 of a portion of the dispensing nozzle, illustrating a pressure actuated poppet valve of the present invention retrofitted in the dispensing nozzle in place of the prior art poppet valve.

In accordance with this invention, the pressure poppet valve 9 of a conventional prior art fuel dispensing nozzle 1 may be retrofitted or replaced by a pressure actuated poppet valve, as indicated generally by reference character PV, as shown in FIG. 2, by removing body cap 47 threaded into housing 3, by removing the prior poppet valve assembly 9, by replacing the prior poppet valve assembly with a poppet valve assembly PV of the present invention, by replacing the existing stem 13 with a modified stem 13' of the present invention, and by replacing poppet valve biasing spring 49 and body cap 47.

More specifically, the pressure actuated poppet valve PV of the present invention includes a hollow poppet valve housing 51 having a cylindric bore 53 therein with the outer end of the cylindric bore being closed by an end cap 55. The end cap 55 has a central port 57 therein provided with a flow restrictor 59 for metering the flow of liquid fuel into and out of cylindric bore 53 of pilot valve housing 51 in a manner and for purposes as will hereinafter appear.

A piston 61 is slidably, sealably provided within cylindric bore 53 of poppet valve housing 51, and the piston is sealed relative to the pilot valve housing by means of a seal 63. With end cap 55 and piston 61 removed, a so-called insert 65 is inserted down into bore 53 of the poppet valve housing such that a flange 67 on the insert is engageable with a shoulder provided within the poppet valve housing. Further, insert 65 has a central bore 69 extending therethrough which slidably receives the upper end of cylindric stem 13' in a manner as will appear. A snap ring groove 71 is provided at the lower end of the ihsert.

Poppet valve body 51 has a flange 73 at its lower end with a valve seal 75 positioned on the downwardly facing surface thereof for sealing engagement with valve seat 11 in flow path F of nozzle dispenser housing 3. The upper face of flange 73 is engageable by the poppet valve biasing spring 49 such that when the valve is in its closed position, valve seal 75 cooperates with valve seat 11 so as to block the flow of fuel through flow path F of the dispensing nozzle. A skirt 77 of aluminum or the like surrounds the lower portion of insert 65 and is held in axial engagement with valve seal 75 by means of a snap ring 79 received in snap ring groove 71.

Figure 3:
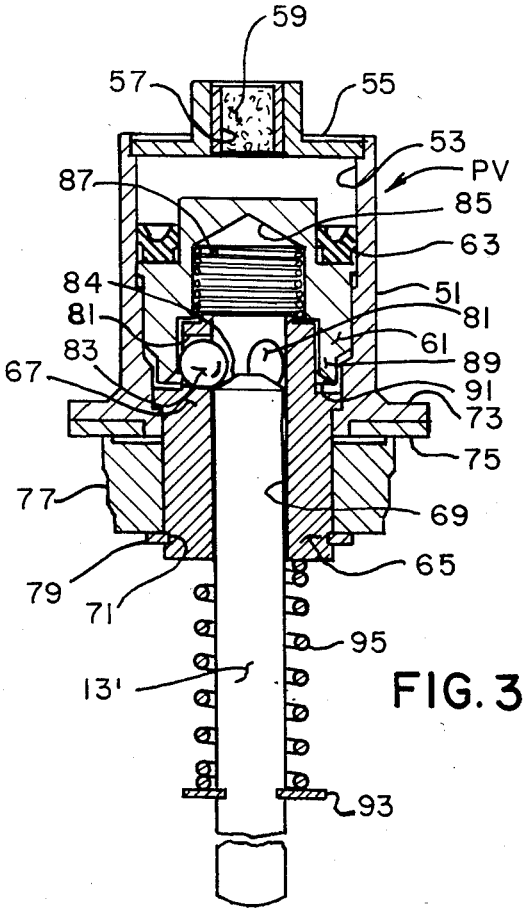
FIG. 3 is a vertical cross sectional view of the poppet valve of the present invention in enlarged scale, illustrating the poppet valve in its coupling position (i.e., when fuel fluid pressure upstream from the valve seat in the dispensing nozzle actuates the pressure actuated poppet valve) so as to enable operation of the dispensing nozzle upon the user actuating the dispenser handle.

Further referring to the construction of insert 65, a plurality of apertures 81, for example three such apertures, are provided at equal angular intervals around the upper end of insert 65 with the apertures 81 extending in generally radial direction with respect to bore 69. Each of the apertures 81 is provided with a so-called latching or coupling ball 83 movable radially inwardly and outwardly relative to bore 69 between a coupling (or latching) position (as shown in FIG. 3) in which the upper end 84 of stem 13' cooperates with the coupling balls thereby to couple poppet valve PV to stem 13' upon upward axial movement (as viewed in FIGS. 2–4) of the stem relative to dispenser nozzle housing 3 so as to effect opening of the poppet valve PV against the bias of spring 49. Further, coupling balls 83 are movable from their coupling positions (as shown in FIG. 3 and as heretofore explained) and to an uncoupling position (as shown in FIG. 4) in which the balls are clear of the upper end of stem 13 and in which the stem is free to move axially relative to poppet valve 51 thereby uncoupling the stem from the poppet valve such that when handle 15 is depressed moving stem 13' in axial direction, movement of poppet valve PV of the present invention is prevented and such that the poppet valve PV of the present invention remains in its normally closed position in sealing engagement with the valve seat 11 thereby to block the flow of fuel through flow path F.

Figure 4:
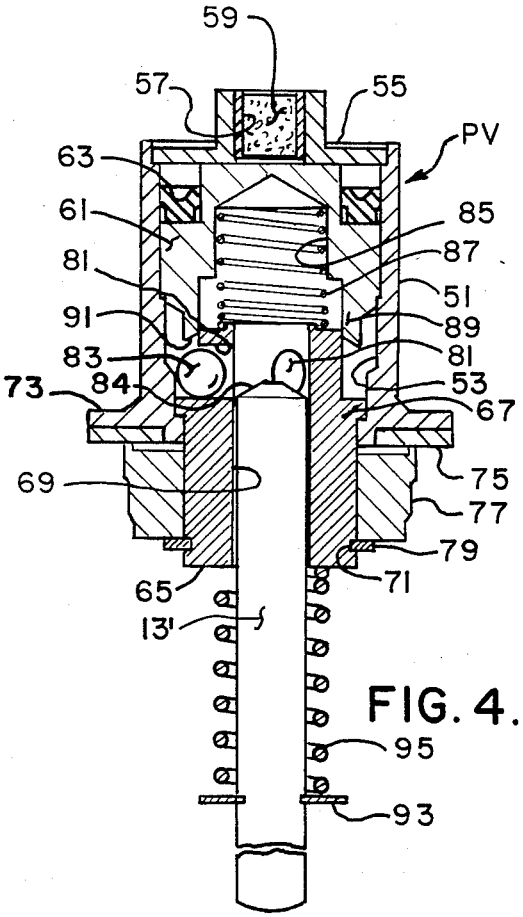
FIG. 4 is a view similar to FIG. 3 illustrating the pressure actuated poppet valve in its closed or disabled position, such as when the fluid pressure upstream of the valve seat is terminated, whereby the actuating lever and stem are uncoupled from the poppet valve so that it moves to the closed position and manual actuation of the dispensing lever does not effect opening of the poppet valve.

More specifically, referring now to the construction of piston 61, the piston has a blind bore 85 therewithin receiving a piston biasing spring 87 interposed between the upper end of blind bore 85 and the end of insert 65 so as to bias the piston toward its second position, as shown in FIG. 4, relative to insert 65. Piston 61 further has a bottom skirt 89 which has an inwardly facing beveled cam face 91 engageable with coupling balls 83 as piston 61 moves from its raised or second position (as shown in FIG. 4) to its lowered or first position (as shown in FIG. 3) so as to cammingly force balls 83 inwardly within apertures 81 to their coupling position (as shown in FIG. 3) in which the balls are engageable by the upper end 84 of stem 13' as the stem 13' is moved axially upwardly (as viewed in FIGS. 3 and 4) such that poppet valve PV is moved upwardly against the bias of spring 49 away from valve seat 11 thereby to permit the flow of fuel through flow path F. Thus, with the piston 61 in its position shown in FIG. 3, and with balls 83 engageable by the upper end 84 of stem 13', the pressure actuated poppet valve PV of the present invention enables operation of dispensing nozzle 1 upon the user of the nozzle depressing or actuating handle 15.

Further, in accordance with this invention, upon the dispenser pump (not shown) being de-energized such that the pressure of the fuel in flow path F upstream from valve seat 11 decreases, piston spring 87 will forceably move piston 61 from its first position (as shown in FIG. 3) to its second position (shown in FIG. 4) thereby forcing the liquid fuel within cylindric bore 53 above the upper face of the piston out of port 57 through flow restrictor 59. As the cam faces 91 on the bottom skirt 89 of piston 61 move upwardly clear of coupling balls 83, the balls are thus free to move radially outwardly within their respective radial apertures 81 in insert member 65 upon, for example, stem 13' being moved axially upwardly with the beveled cam surface 84 on the upper end of the stem cammingly engaging the balls. Thus, with piston 61 in its raised or second position, stem 13' is uncoupled from poppet valve member PV of the present invention such that if the user of dispensing nozzle 1 were to actuate handle 15 so as to move stem 13' through its full stroke S, as shown in FIG. 2, the upper end of stem 13' would move freely upwardly within bore 69 of insert 65 into the bore 85 of piston 61 without contacting the poppet valve PV and without lifting the poppet valve clear of valve seat 11. In this manner, with the fuel dispenser shut off, and with the fuel pressure in flow path F upstream from valve seat 11 at a low pressure level, the pressure actuated poppet valve of the present invention is disabled or closed such that actuation of handle 15 will not open the poppet valve and will not permit the flow of fuel from the nozzle 1. Further, when the poppet valve is disabled, even if handle 15 remains depressed and poppet valve PV is manually held open when operation of the dispenser (not shown) is terminated, as when a prepaid amount of fuel has been dispensed, the drop of fuel pressure upstream of the poppet valve will cause piston 61 to move clear of balls 83 so that poppet valve PV will close and cannot be reopened by handle 15. It will be further appreciated that during normal use of nozzle 1, sufficient pressure (e.g., 2–3 psig or more) will be present upstream of poppet valve PV so as to maintain piston 61 in its lowered or enabling position when the poppet valve is open and fuel is flowing through the nozzle.

Additionally, a snap ring 93 is secured to shaft 13' below poppet valve PV and a compression coil spring 95 is interposed between snap ring 93 and the bottom face of insert 65 so that stem 13' is biased downwardly toward its position shown in FIG. 2. In this manner, upon energization of the dispenser (not shown) so as to increase the pressure of the fuel within flow path F upstream from valve seat 11 and to move balls 83 to their coupled positions, the upper end 84 of stem 13' is disposed to be engageable with balls 83 when the stem is moved axially.

In accordance with this invention, flow restrictor 59 in port 57 is made of a powdered or sintered porous metal and serves to meter or restrict the flow of liquid fuel into and out of cylindric bore 53 within pilot valve housing 51. More particularly, the size and construction of the flow restrictor is preferably such that approximately 5–20 seconds of time will pass between the time the fuel pressure within flow path F upstream from valve seat 11 drops and the time piston biasing spring 87 moves the piston from its first position toward its second position forcing fuel out of cylindric bore 53 via the flow restrictor to a point where cam face 91 on the lower end of the piston are clear of balls 83 thereby permitting the latching balls to move radially outwardly and uncoupling poppet valve PV from stem 13. In the manner, nuisance shut-offs are avoided and, during the manufacture of the nozzle 1, the nozzle may be drained properly after it has been flow tested.

Further, in accordance with this invention, it will be appreciated that the pressure poppet valve assembly PV of the present invention may be retrofitted in existing dispensing nozzles by removing body cap 47 and spring 49 so as to permit the prior art poppet valve 9, together with stem 14 to be removed and to be replaced by the pressure poppet valve assembly PV and stem 13' of the present invention. Those skilled in the art will also appreciate that in retrofit situations, the poppet valve PV of the present invention may have to be sized and modified for the specific dispensing nozzle 1 in which it is to be retrofitted.

The purpose of this invention is to provide a means for coupling, or decoupling, the nozzle stem 13 with the poppet valve, under particular conditions, so as to either provide an opening of the nozzle, and a flow of fuel through its flow path, or to uncouple or disengage the stem from the poppet valve, such that when the handle 15 is depressed, the poppet valve still will not open.

Essentially, what occurs, particularly in the self-service delivery of gasoline, and related fuels, should the dispenser automatically shut off, as when a previous customer has obtained his, for example, five dollars or ten dollars worth of gas, that previous customer may have relocated the fuel dispensing nozzle back into the dispenser, without disengaging its handle means. When that occurs, and when the pressure of the fuel at the vicinity of its inlet 5 decreases below a certain level, since the dispenser will have automatically shut off, and even though the poppet valve may remain open, the pressure of the fuel within the poppet valve, and more specifically within its cylindrical bore 53, will gradually seep back out through the porous restrictor 59, and back into the flow path F. As that occurs, eventually the spring 18 will pressure against the piston 61, elevate it within the poppet valve body 51, until such time as its camming edge 91 clears the coupling balls 83, allowing them to slide outwardly, by means of the pressure exerted upon them by the upper camming edge 84 of the stem 13, until such time as the balls 83 clear the stem allowing the stem to spring upwardly within the bore 85, of the piston. When this occurs, the poppet valve PV will snap shut against its seat valve 11. Thus, the poppet valve of the nozzle once again becomes closed, so that when the next customer may order a specified amount of gas, and the dispenser is turned on to deliver that amount of gas, the poppet valve will be closed, and prevent the untimely dispensing of gas from the nozzle before it has been inserted into the gas tank. As the dispenser is once again turned on, and fuel is delivered to the nozzle, through its flow path F, the same fuel pressures its way through the porous restrictor 59, biases against the top of the piston 61, forcing it downwardly, so that when the customer places the nozzle, or its spout, into the gasoline tank, and depresses the handle 15, the bottom skirt 89 of the piston will have moved down sufficiently for its camming edge 91 to force the balls 81 into their inwardmost direction, as shown in FIG. 3, so that when the handle 15 is once again depressed, the stem 13 engages the balls 83 and moves the entire poppet valve PV upwardly and into an open position within the nozzle, raising the same off of the valve seat 11, allowing the unrestricted and natural flow of fuel through the nozzle for dispensing into the gasoline tank.

Figure 5:
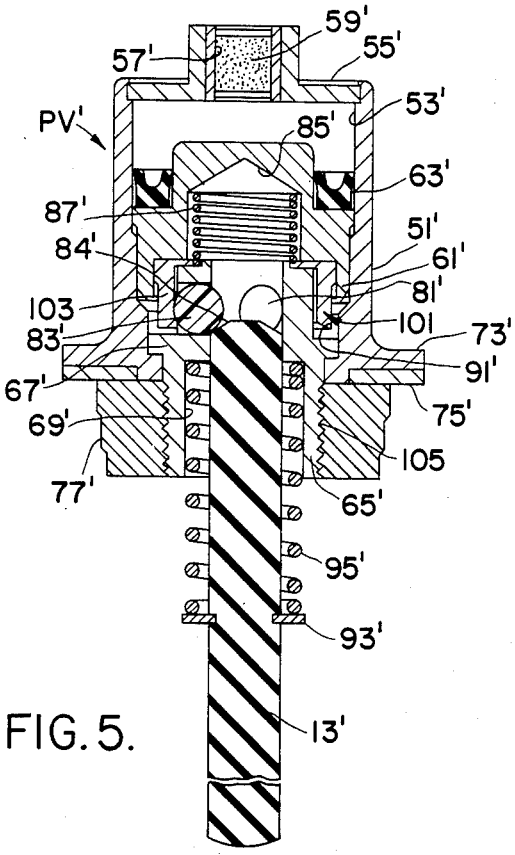
FIG. 5 is a view similar to FIG. 3 of another embodiment of the pressure actuated valve.
Figure 6:
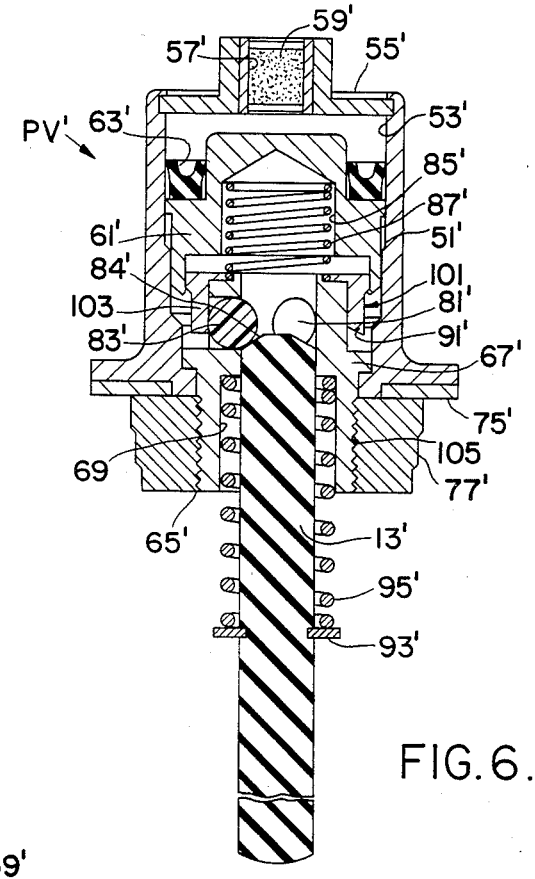
FIG. 6 is a view of the poppet valve shown in FIG. 5 having a lost motion collar intermediate a movable piston and the coupling balls positively maintaining the coupling balls in their coupling positions as the piston moves from its first or lowered position toward its second or upper position.
Figure 7:
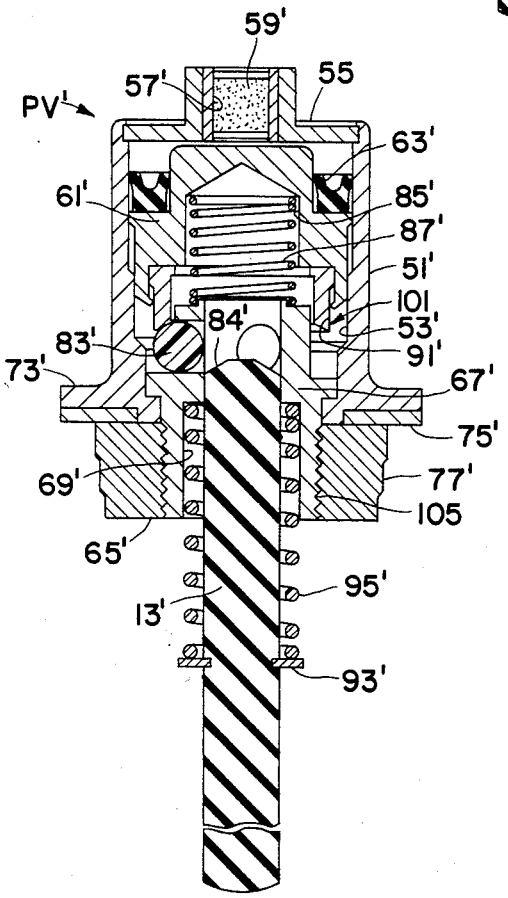
FIG. 7 is a view of the poppet valve of FIGS. 5 and 6 with the piston in its fully raised position with the lost motion collar in its raised position thus freeing the coupling balls and permitting them to move their uncoupling positions.

In addition, with respect to the numbers 101 and 103, that number 101 is what is defined as a lost motion means, and this is actually a collar that surrounds and is slidable in conjunction with the upper edge of this insert 65, that is stationarily connected within the structure of the poppet valve PV. But, this collar 101 has a small shoulder provided proximate its upper exterior surface, and that shoulder is designed for contact by the lower and internally protruding edge of the piston 61, as can be seen in FIGS. 5 through 7, such that as the piston moves upwardly under the bias of its spring 87, as when fuel pressure within the cylindric bore 53 decreases, eventually this bottom edge of the piston engages at external shoulder of the collar 101, and pulls it upwardly with it. Eventually, when it is pulled sufficiently upwardly, as shown in FIG. 7, the ball 83 is allowed to move radially outwardly, generally under the pressure of the camming surface 84 of the stem 13, so as to clear the stem, and allow it to move upwardly within the piston, which under this action, does not have any effect upon movement of the poppet valve, which will remain sealed against the valve seat 11.

Referring now to FIGS. 5–7, another, and possibly the preferred embodiment, of the pressure actuated poppet valve of the present invention is generally indicated in its entirety by reference character PV'. The "primed" reference characters in FIGS. 5–7 indicate corresponding parts having a corresponding construction and operation to similar parts heretofore described in regard to poppet valve PV as heretofore illustrated in FIGS. 2–4. For the sake of brevity, a detailed description of the construction and operation of these similar parts will be omitted.

Succinctly, the primary differences between poppet valve PV (as shown in FIGS. 2–4) and poppet valve PV' (as shown in FIGS. 5–7) is that poppet valve PV' includes a lost motion means, as generally indicated at 101, interposed between the bottom portions of piston 61' and acting as a collar surrounding the upper end of flange 67' of insert 65' so as to maintain the coupling balls 83' in their fully coupled position as movement of piston 61' is effected from its first or lowered position (as shown in FIG. 5) toward an intermediate position (as shown in FIG. 6). Shoulder 103 is provided on the bottom end of piston 61' so as to effect engagement with the upper end of the lost motion collar 101 so as to move the collar upwardly together with the piston as the piston moves from its intermediate position (as shown in FIG. 6) to its second or fully raised position (as shown in FIG. 7) in which position the lower end of the lost motion collar moves clear of coupling balls 83' thus permitting the coupling balls to move from their coupling to their uncoupled position, and thus to release stem 13' from the poppet valve. The bottom end of lost motion collar 101 has a beveled cam face 91' thereon which cammingly cooperates with coupling balls 83' in the manner heretofore disclosed in regard to poppet valve PV.

By providing the lost motion collar 101, the coupling balls 83' remain in their fully coupled positions engagable by the upper camming surface 84' of stem 13' as the piston 61' moves from its first or lowered position (see FIG. 5) to its intermediate position (see FIG. 6). Then, as the piston moves from its intermediate position to its fully raised position (as shown in FIG. 7) the bottom end of lost motion collar or ring 101 moves clear of coupling balls 83'. As the lost motion ring moves clear of the coupling balls, it does so relatively rapidly (as compared to the bottom edge of skirt 89 of piston 61 of poppet valve PV heretofore described) and thus substantially prevents undue wear caused by the wedging action between the coupling balls 83' and the beveled cam face 91' of the lost motion ring and between the coupling balls and beveled end 84' of stem 13'.

Another difference between poppet valve PV' (as shown in FIGS. 5–7) and poppet valve PV (as shown in FIGS. 2–4) is that the retainer ring 79 holding skirt 77 in position on insert 67 of poppet valve PV has been replaced by a threaded coupling 105 between skirt 77' and insert 65'. Thus, the poppet valve PV' will fit into smaller size dispensing nozzles 1, thus increasing the number of dispensing nozzles that may be retrofitted with the poppet valve of the present invention.

In view of the above, it will be seen that the other objects of this invention are achieved and other advantageous results obtained.

As various changes could be made in the above constructions without departing from the scope of the invention, it is intended that all matter contained in the above description or shown in the accompanying drawing shall be interpreted as illustrative and not in a limiting sense.

What is claimed is:

1. In a fuel dispensing nozzle having a flow path therethrough, said flowpath having an inlet and an outlet formed of the dispensing nozzle, a valve seat within said nozzle constituting a part of said flow path, a normally closed poppet valve cooperable with said valve seat for blocking the flow of fuel through said nozzle by way of said flow path, a spring biasing said poppet valve towards its normally closed position, and means including a stem cooperable with said poppet valve and extending exteriorly of said nozzle for selectively moving said poppet valve from its closed position against the bias of said spring, and into an open flow path position, wherein said improvement comprises, a poppet valve housing constituting, at least in part, said poppet valve, said poppet valve housing having a cylindric bore therein, said poppet valve housing being engagable by said spring and being sealingly engagable with said valve seat when said poppet valve is in its normally closed position so as to block the flow of fuel through said nozzle by way of its flow path, a piston sealably slidable within said housing cylindric bore between a first and a second position, said stem being received at least in part within said poppet valve housing, said poppet valve housing having coupling means engagable with said stem for coupling said poppet valve housing to said stem for opening of said poppet valve, said coupling means comprising a ball coupling means, said ball coupling means being movable between a coupling position in which said coupling means is in engagement with said stem such that movement of said stem in one direction causes movement of said poppet valve from its closed position towards an open position thereby permitting fuel flow, and an uncoupling position in which said coupling means is clear of said stem thereby to permit movement of said stem in said one direction without effecting opening of said poppet valve for fuel flow, said piston, when in its first position, positively holding said coupling means in its coupling position, and when in its second position, permitting said coupling means to be moved to its uncoupling position, said poppet valve housing having a port therein communicating between a portion of said flow path upstream of said valve seat and said cylindric bore within said poppet valve housing whereby fluid pressure upstream from said valve seat acts on said piston and forces it towards its first position, a flow restrictor provided in said port to provide restricted flow of fuel into and out of said housing cylindric bore and above said piston, and a piston spring biasing said piston towards its second position so that upon the fluid pressure upstream from said valve seat decreasing below the fluid pressure within said cylindric bore, said piston spring biases said piston towards its second position thereby permitting said coupling means to move from its coupling to its uncoupling position and allowing said poppet valve to close and disabling reopening of the same.

2. In a fuel dispensing nozzle as set forth in claim 1 wherein said coupling means comprises at least one aperture within said housing proximate said stem and extending radially therefrom and a coupling ball received within said aperture and movable radially between a coupling position in which said ball is engagable by the end of said stem and with a portion of said piston preventing substantial outward radial movement of said ball within said aperture, and an uncoupling position in which said piston is clear of said ball permitting said ball to be moved radially outwardly and clear of said stem.

3. In a fuel dispensing nozzle as set forth in claim 1 wherein said stem has a camming surface thereon engagable with said ball for effecting radial outward movement of said ball upon axial movement of said stem in said one direction.

4. In a fuel dispensing nozzle as set forth in claim 2 wherein said coupling means comprises a plurality of said balls and said apertures.

5. In a fuel dispensing nozzle as set forth in claim 1 wherein said flow restrictor being porous and as arranged within said port meters the flow of fuel into and out of said cylindric bore such that said coupling means is maintained in its coupling position for a predetermined time after fluid pressure upstream from said valve seat drops below the pressure of the fluid within said cylindric bore.

6. In a fuel dispensing nozzle as set forth in claim 1 wherein said piston includes a lost motion member engagable with said coupling means and holding said coupling means in its coupled position as said piston moves from its first position to an intermediate position and permitting movement of said coupling means from its coupling position to its uncoupled position as said piston moves from said intermediate position to its second position.

7. In a fuel dispensing nozzle as set forth in claim 1 and further comprising seal means for slidably sealing said piston with respect to said cylindric bore as said piston moves between its first and second positions.

8. In a fuel dispensing nozzle as set forth in claim 1 and further comprising a compressive coil spring surrounding at least a portion of said stem and interposed between a fixed location on said stem and said poppet valve housing for biasing said stem to an outer position with respect to said poppet valve housing.

9. In a fuel dispensing nozzle as set forth in claim 1 wherein said poppet valve housing has a flange sealingly engageable with said valve seat when said poppet valve is closed.

10. In a fuel dispensing nozzle as set forth in claim 1 wherein said poppet valve housing further including a skirt extending downstream from said valve seat within said flow path when said poppet valve is closed.

* * * * *

UNITED STATES PATENT AND TRADEMARK OFFICE

CERTIFICATE OF CORRECTION

PATENT NO. : 4,559,982

DATED : December 24, 1985

INVENTOR(S) : Arthur C. Fink, Jr.

It is certified that error appears in the above—identified patent and that said Letters Patent is hereby corrected as shown below:

Claim 3, line 46, change "1" to ---2---.

Signed and Sealed this

First Day of April 1986

[SEAL]

*Attest:*

DONALD J. QUIGG

*Attesting Officer*

*Commissioner of Patents and Trademarks*